US008960303B2

(12) United States Patent
Gilmore et al.

(10) Patent No.: US 8,960,303 B2
(45) **Date of Patent: *Feb. 24, 2015**

(54) GOOSENECK CONDUIT SYSTEM

(75) Inventors: David L. Gilmore, Baytown, TX (US); William F. Puccio, Katy, TX (US)

(73) Assignee: Cameron International Corporation, Houston, TX (US)

( * ) Notice: Subject to any disclaimer, the term of this patent is extended or adjusted under 35 U.S.C. 154(b) by 333 days.

This patent is subject to a terminal disclaimer.

(21) Appl. No.: 13/275,047

(22) Filed: Oct. 17, 2011

(65) Prior Publication Data

US 2012/0325486 A1 Dec. 27, 2012

Related U.S. Application Data

(60) Provisional application No. 61/500,914, filed on Jun. 24, 2011.

(51) Int. Cl.
*E21B 17/01* (2006.01)
*E21B 19/00* (2006.01)

(52) U.S. Cl.
CPC ..... *E21B 19/006* (2013.01)
USPC ..... 166/345; 166/341; 166/342; 166/344; 166/351; 166/367

(58) Field of Classification Search
USPC ..... 166/338, 339, 341, 342, 344, 345, 350, 166/358, 359, 367, 378–381
See application file for complete search history.

(56) References Cited

U.S. PATENT DOCUMENTS

| | | | | |
|---|---|---|---|---|
| 5,642,896 | A | 7/1997 | Pierce et al. | |
| 5,794,701 | A * | 8/1998 | Cunningham et al. | 166/341 |
| 6,530,430 | B2 | 3/2003 | Reynolds | |
| 6,725,949 | B2 * | 4/2004 | Seneviratne | 175/85 |
| 8,403,065 | B2 * | 3/2013 | Taylor et al. | 166/378 |
| 2004/0256107 | A1 * | 12/2004 | Adams et al. | 166/345 |
| 2007/0251699 | A1 | 11/2007 | Wells et al. | |
| 2008/0150305 | A1 | 6/2008 | Hollin | |
| 2011/0056701 | A1 * | 3/2011 | Jones et al. | 166/378 |
| 2011/0073315 | A1 * | 3/2011 | Guesnon et al. | 166/367 |
| 2012/0273213 | A1 * | 11/2012 | Blalock et al. | 166/341 |
| 2013/0092388 | A1 * | 4/2013 | Gilmore et al. | 166/367 |

OTHER PUBLICATIONS

PCT International Search Report and Written Opinion for PCT/US2012/042990, dated Feb. 28, 2013.

* cited by examiner

*Primary Examiner* — James G Sayre
(74) *Attorney, Agent, or Firm* — Chamberlain Hrdlicka

(57) ABSTRACT

A gooseneck conduit system for use with a telescoping joint of a subsea riser. In one embodiment, a riser telescoping joint includes a tube, and a gooseneck conduit assembly affixed to the tube. The gooseneck conduit assembly includes a plurality of gooseneck conduits and a locking mechanism. The gooseneck conduits extend radially from the tube. The locking mechanism engages a locking pin affixed to the tube to secure the gooseneck conduit assembly to the tube. Each gooseneck conduit couples to an auxiliary fluid line secured to the telescoping joint.

21 Claims, 10 Drawing Sheets

GOOSENECK CONDUIT SYSTEM

CROSS-REFERENCE TO RELATED APPLICATION

The present application claims priority to U.S. Provisional Patent Application No. 61/500,914, filed on Jun. 24, 2011, entitled "Gooseneck Conduit System," which is hereby incorporated herein by reference in its entirety.

BACKGROUND

Offshore oil and gas operations often utilize a wellhead housing supported on the ocean floor and a blowout preventer stack secured to the wellhead housing's upper end. A blowout preventer stack is an assemblage of blowout preventers and valves used to control well bore pressure. The upper end of the blowout preventer stack has an end connection or riser adapter (often referred to as a lower marine riser packer or LMRP) that allows the blowout preventer stack to be connected to a series of pipes, known as riser, riser string, or riser pipe. Each segment of the riser string is connected in end to end relationship, allowing the riser string to extend upwardly to the drilling rig or drilling platform positioned over the wellhead housing.

The riser string is supported at the ocean surface by the drilling rig. This support takes the form of a hydraulic tensioning system and telescoping (slip) joint that connect to the upper end of the riser string and maintain tension on the riser string. The telescoping joint is composed of a pair of concentric pipes, known as an inner and outer barrel, that are axially telescoping within each other. The lower end of the outer barrel connects to the upper end of the aforementioned riser string. The hydraulic tensioning system connects to a tension ring secured on the exterior of the outer barrel of the telescoping joint and thereby applies tension to the riser string. The upper end of the inner barrel of the telescoping joint is connected to the drilling platform. The axial telescoping of the inner barrel within the outer barrel of the telescoping joint compensates for relative elevation changes between the rig and wellhead housing as the rig moves up or down in response to the ocean waves.

According to conventional practice, various auxiliary fluid lines are coupled to the exterior of the riser tube. Exemplary auxiliary fluid lines include choke, kill, booster, and clean water lines. Choke and kill lines typically extend from the drilling rig to the wellhead to provide fluid communication for well control and circulation. The choke line is in fluid communication with the borehole at the wellhead and may bypass the riser to vent gases or other formation fluids directly to the surface. According to conventional practice, a surface-mounted choke valve is connected to the terminal end of the choke conduit line. The downhole back pressure can be maintained substantially in equilibrium with the hydrostatic pressure of the column of drilling fluid in the riser annulus by adjusting the discharge rate through the choke valve.

The kill line is primarily used to control the density of the drilling mud. One method of controlling the density of the drilling mud is by the injection of relatively lighter drilling fluid through the kill line into the bottom of the riser to decrease the density of the drilling mud in the riser. On the other hand, if it is desired to increase mud density in the riser, a heavier drilling mud is injected through the kill line.

The booster line allows additional mud to be pumped to a desired location so as to increase fluid velocity above that point and thereby improve the conveyance of drill cuttings to the surface. The booster line can also be used to modify the density of the mud in the annulus. By pumping lighter or heavier mud through the booster line, the average mud density above the booster connection point can be varied. While the auxiliary lines provide pressure control means to supplement the hydrostatic control resulting from the fluid column in the riser, the riser tube itself provides the primary fluid conduit to the surface.

A hose or other fluid line connection to each auxiliary fluid line coupled to the exterior of the riser tube is provided at the telescoping joint via a pipe or equivalent fluid channel. The pipe is often curved or U-shaped, and is accordingly termed a "gooseneck" conduit. In the course of drilling operations, a gooseneck conduit may be detached from the riser, for example, for maintenance or to permit the raising of the riser through the drilling floor, and reattached to the riser to provide access to the auxiliary fluid lines. The gooseneck conduits are typically coupled to the auxiliary fluid lines via threaded connections.

SUMMARY

A gooseneck conduit system for use with a telescoping joint of a subsea riser is disclosed herein. In one embodiment, a riser telescoping joint includes a tube and a gooseneck conduit assembly. The gooseneck conduit assembly is affixed to the tube. The gooseneck conduit assembly includes a plurality of gooseneck conduits and a locking mechanism. The gooseneck conduits extend radially from the tube. The locking mechanism engages a locking pin affixed to the tube to secure the gooseneck conduit assembly to the tube.

In another embodiment, a gooseneck conduit unit includes a base structure, a plurality of gooseneck conduits, an alignment socket, and a locking mechanism. The plurality of gooseneck conduits and the alignment socket are removably mounted to the base structure. The alignment socket guides the gooseneck conduit unit into position about a telescoping joint. The locking mechanism is mounted to the base structure. The locking mechanism secures the gooseneck conduit unit to the telescoping joint.

In a further embodiment, a system includes a surface platform, a riser, a blow-out preventer, and a telescoping joint. The blow-out preventer is coupled to the riser. The telescoping joint couples the riser to the surface platform. The telescoping joint includes a support collar for securing at least one gooseneck conduit assembly to the telescoping joint. The support collar includes a plurality of locking pins each dimensioned to align the gooseneck conduit assembly with auxiliary fluid lines disposed about the telescoping joint, and to secure the gooseneck conduit assembly to the telescoping joint.

BRIEF DESCRIPTION OF THE DRAWINGS

For a detailed description of exemplary embodiments of the invention, reference will now be made to the accompanying drawings in which.

NOTATION AND NOMENCLATURE

Figure 1A:
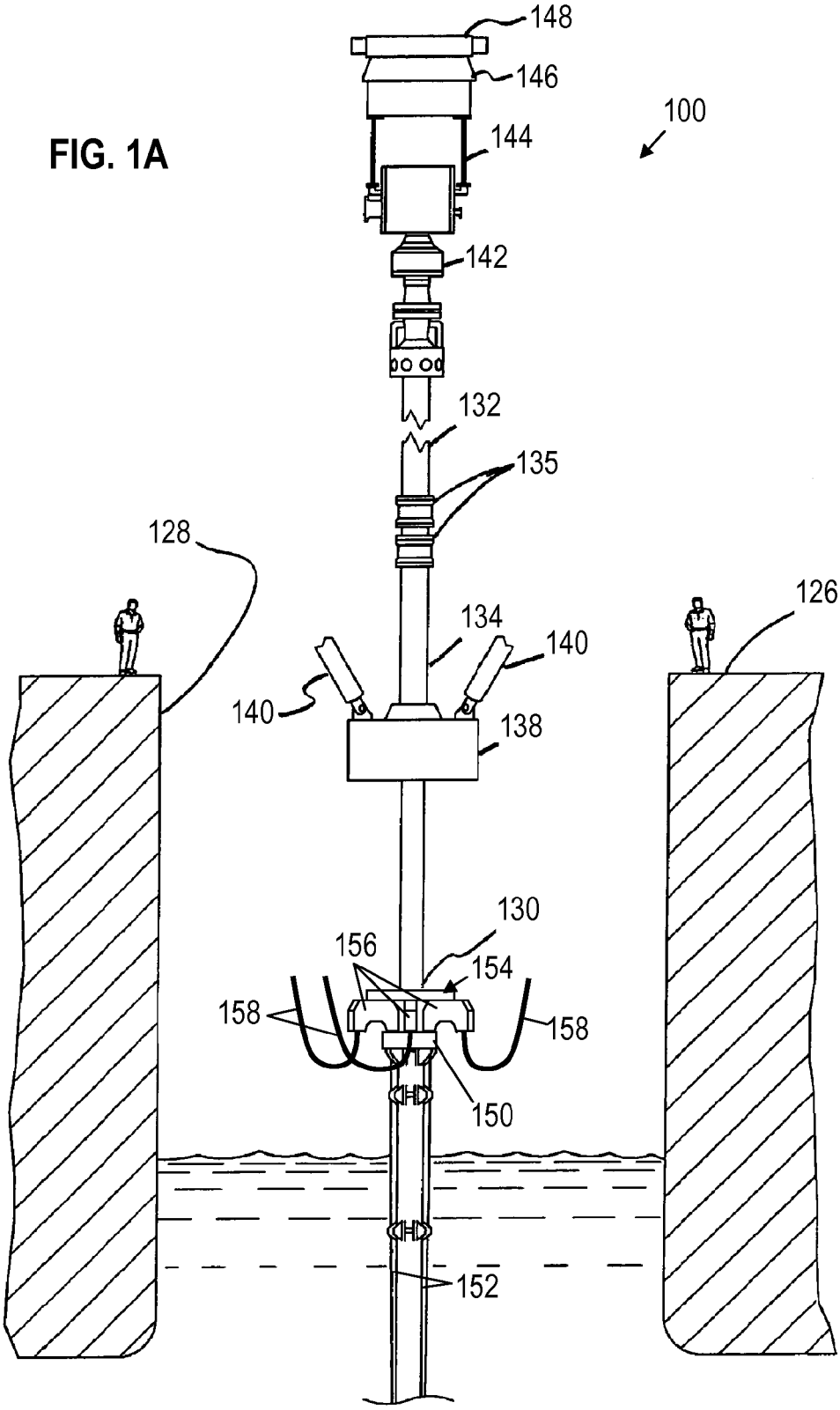
FIGS. 1A-1B show a drilling system including a gooseneck conduit system in accordance with various embodiments.

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

DETAILED DESCRIPTION

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

The size and weight of the gooseneck conduits, and the location of the attachment points of the conduits to the telescoping joint and the auxiliary fluid lines, makes installation and/or retrieval of the conduits a labor-intensive process. Consequently, gooseneck conduit handling operations can be time consuming and costly. Embodiments of the present disclosure include a gooseneck conduit system that reduces handling time and enhances operational safety. Embodiments of the conduit system disclosed herein provide simultaneous connection of gooseneck conduits to a plurality of auxiliary fluid lines with no requirement for manual handling or connection operations. Embodiments include hydraulically and/or mechanically operated locking mechanisms that secure the conduit system to the telescoping joint and the auxiliary fluid lines. The conduit system may be hoisted into position on the telescoping joint, and attached to the telescoping joint and the auxiliary fluid lines via the provided locking mechanisms. Thus, embodiments allow gooseneck conduits to be quickly and safely attached to and/or removed from the telescoping joint.

Figure 1B:
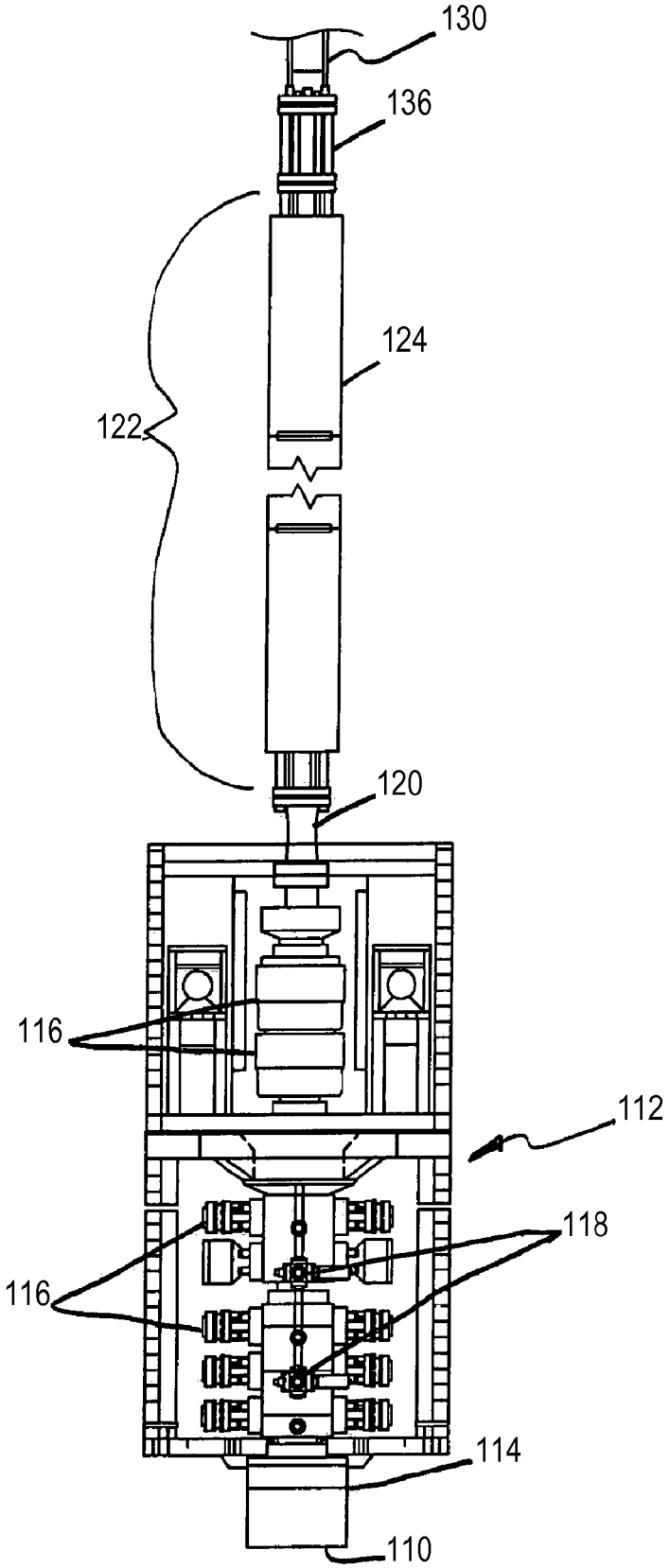

FIGS. 1A-1B show a drilling system 100 in accordance with various embodiments. The drilling system 100 includes a drilling rig 126 with a riser string 122 and blowout preventer stack 112 used in oil and gas drilling operations connected to a wellhead housing 110. The wellhead housing 110 is disposed on the ocean floor with blowout preventer stack 112 connected thereto by hydraulic connector 114. The blowout preventer stack 112 includes multiple blowout preventers 116 and kill and choke valves 118 in a vertical arrangement to control well bore pressure in a manner known to those of skill in the art. Disposed on the upper end of blowout preventer stack 112 is riser adapter 120 to allow connection of the riser string 122 to the blowout preventer stack 112. The riser string 122 is composed of multiple sections of pipe or riser joints 124 connected end to end and extending upwardly to drilling rig 126.

Drilling rig 126 further includes moon pool 128 having telescoping joint 130 disposed therein. Telescoping joint 130 includes inner barrel 132 which telescopes inside outer barrel 134 to allow relative motion between drilling rig 126 and wellhead housing 110. Dual packer 135 is disposed at the upper end of outer barrel 134 and seals against the exterior of inner barrel 132. Landing tool adapter joint 136 is connected between the upper end of riser string 122 and outer barrel 134 of telescoping joint 130. Tension ring 138 is secured on the exterior of outer barrel 134 and connected by tension lines 140 to a hydraulic tensioning system as known to those skilled in the art. This arrangement allows tension to be applied by the hydraulic tensioning system to tension ring 138 and telescoping joint 130. The tension is transmitted through landing tool adapter joint 136 to riser string 122 to support the riser string 122. The upper end of inner barrel 132 is terminated by flex joint 142 and diverter 144 connecting to gimbal 146 and rotary table spider 148.

A support collar 150 is coupled to the telescoping joint 130, and the auxiliary fluid lines 152 are terminated at seal subs retained by the support collar 150. One or more gooseneck conduit assemblies 154 are coupled to the support collar 150 and to the auxiliary fluid lines 152 via the seal subs retained by the support collar 150. Each conduit assembly 154 is a conduit unit that includes a plurality of gooseneck conduits 156. A hose 158 or other fluid line is connected to each gooseneck conduit 156 for transfer of fluid between the gooseneck conduit 156 and the drilling rig 126. In some embodiments, the connections between the hoses 158 and/or other rig fluid lines and the gooseneck conduits 156 are made on the rig floor, and thereafter the gooseneck conduit assembly is lowered onto the telescoping joint 130.

The gooseneck conduit assembly 154 includes locking mechanisms that secure the conduit assembly 154 to guide/lock pins of the support collar 150. The conduit assembly 154 can be lowered onto the support collar 150 using a crane or hoist. In some embodiments, the conduit assembly 154 can be connected to hydraulic lines that actuate the locking mechanisms. Thus, embodiments allow the gooseneck conduits 156 to be quickly and safely fixed to and/or removed from the telescoping joint 130 while reducing the manual effort required to install and/or remove the gooseneck conduits 156.

Figure 2:
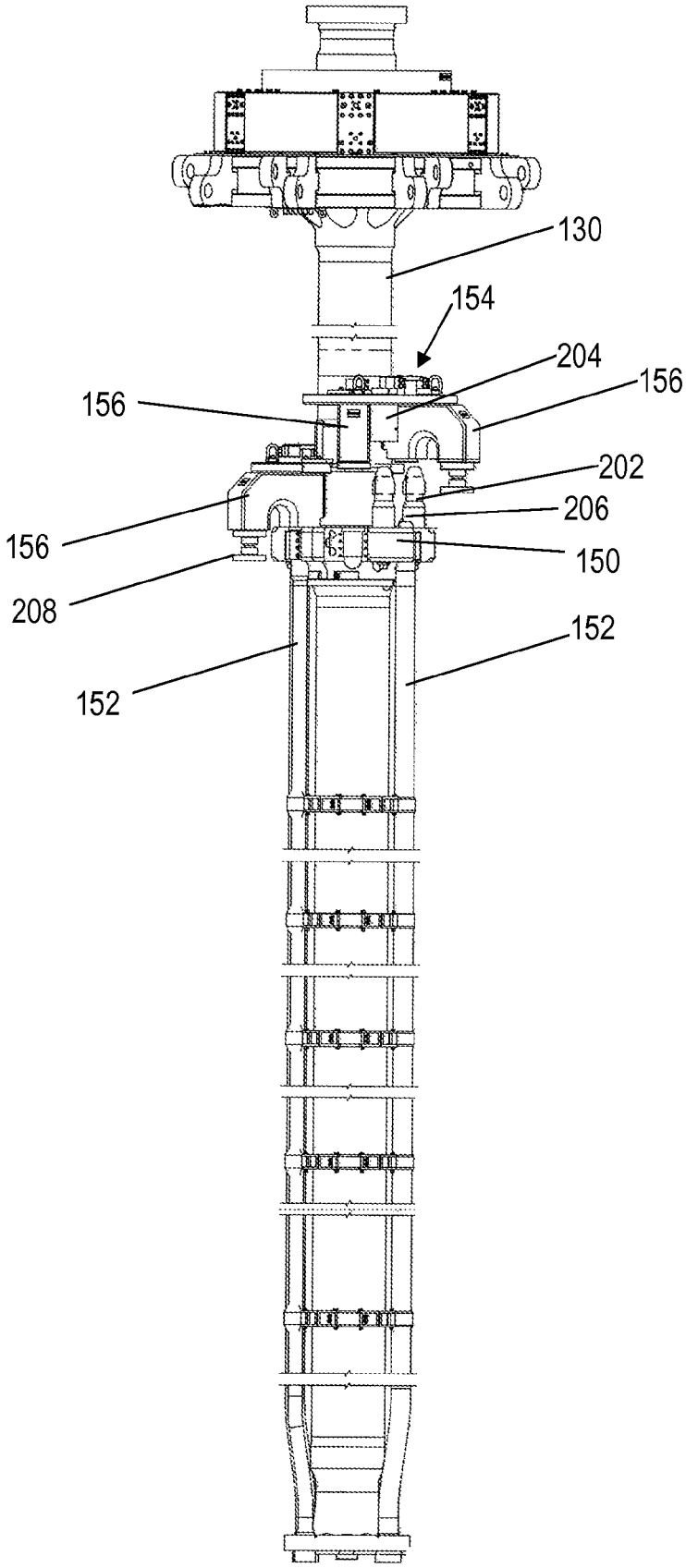
FIG. 2 shows a telescoping joint in accordance with various embodiments.

FIG. 2 shows a telescoping joint 130 in accordance with various embodiments. The auxiliary fluid lines 152 are secured to the telescoping joint 130. The uphole end of each auxiliary fluid line 152 is coupled to a seal sub 206 at the support collar 150. The support collar 150 is coupled to and radially extends from the telescoping joint 130. In some embodiments, the support collar 150 includes multiple connected sections (e.g., connected by bolts) that join to encircle the telescoping joint 130. Guide/locking pins 202 extend from the support collar.

The gooseneck conduit assembly 154 is a multi-conduit unit including locking/alignment sockets 204, one or more locking mechanisms, and a plurality of gooseneck conduits 156. The locking/alignment sockets 204 engage the guide/locking pins 202 to guide the gooseneck conduit assembly 154 into position on the support collar 150 as the gooseneck conduit assembly 154 is installed. As the gooseneck conduit assembly 154 is positioned on the support collar 150, each gooseneck conduit 156 engages a seal sub 206 and is coupled to an auxiliary fluid line 152. The locking mechanisms secure the locking/alignment sockets 204 to the guide/locking pins 202, thereby locking the gooseneck conduit assembly 154 to the support collar 150, and secure each gooseneck conduit 156 to a corresponding auxiliary fluid line 152. In some embodiments, the locking mechanisms are hydraulically operated. In other embodiments, the locking mechanisms are mechanically operated. The locking mechanisms may be either hydraulically or mechanically operated in some embodiments. The gooseneck conduits 156 may include swivel flanges 208 for connecting the conduits 156 to flexible fluid lines 158.

Figure 3:
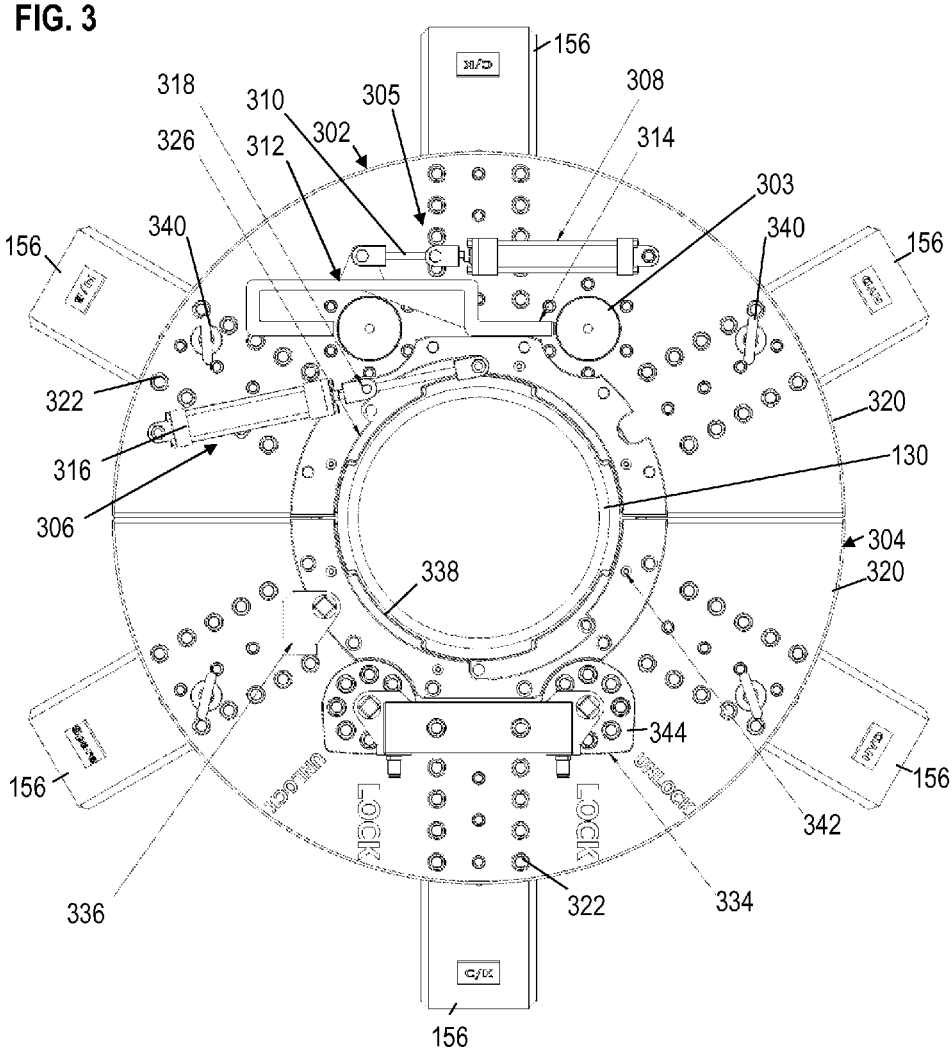
FIG. 3 shows a top view of gooseneck conduit assemblies in an unlocked state in accordance with various embodiments.

FIG. 3 shows a top view of gooseneck conduit assemblies 302 and 304. The gooseneck conduit assemblies 302, 304 each include three gooseneck conduits 156. Other embodiments of the conduit assembly may include a different number of gooseneck conduits 156. Each gooseneck conduit assembly 302, 304 includes a plate 320 or other base structure to which the gooseneck conduits 156, and other components, are removably coupled. The gooseneck conduits 156 are coupled to the plate 320 by bolts 322 or other retention devices that allow the gooseneck conduits 156 to be removed from the plate 320 and/or replaced. A keying structure 618 (FIG. 6) aligns the gooseneck conduit with corresponding structure of the plate 320 to facilitate proper engagement of the gooseneck conduit 156 with the auxiliary fluid line. Hoist rings 340, or other lift attachment structures, are fastened to the plate 320 to facilitate movement of the gooseneck conduit assembly 302, 304 by hoist or other lifting tool.

As mentioned above, each gooseneck conduit assembly 302, 304 includes a locking system. Lubrication ports 342 allow for the introduction of lubricant to the locking system. The gooseneck conduit assembly 302 employs a different locking system than the gooseneck conduit assembly 304. Thus, embodiments of the gooseneck conduit assembly coupled to a telescoping joint 130 may include like or different locking systems.

The gooseneck conduit assembly 302 includes a primary locking system 305 and a secondary locking system 306. Some embodiments of the gooseneck conduit assembly 302 may include only one of the primary locking system 305 and the secondary locking system 306. The primary locking system 305 includes a hydraulic cylinder 308 that extends and/or retracts a shaft 310. The shaft 310 is coupled to a bolt assembly 312 that includes bolts 314 that engage passages in the guide/locking pins 303 when the shaft 310 is retracted. The gooseneck conduit assembly 302 is unlocked from the support collar 150 in FIG. 3, consequently, the bolts 314 are not engaged with the guide/locking pins 303. The plate 320 includes openings/passages 502 (FIG. 5) that allow the guide/locking pins 303 to extend through the plate 320 when the gooseneck conduit assembly 302 is properly positioned on the support collar 150.

Figure 6:
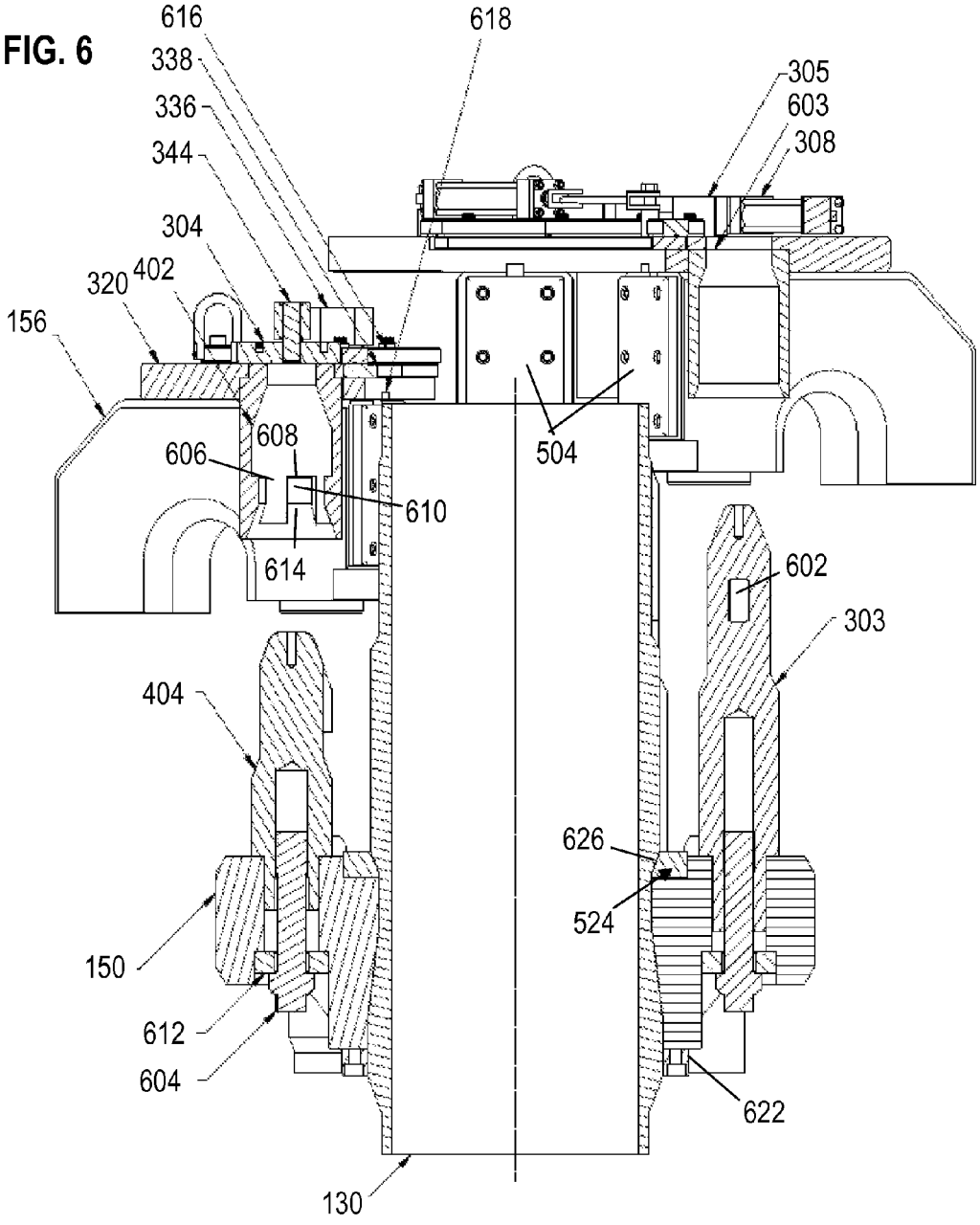
FIG. 6 shows a cross sectional view of the support collar and gooseneck assemblies in accordance with various embodiments.

FIG. 6 shows a cross-sectional view of the support telescoping joint 130 with the gooseneck conduit assembly 302 unlocked and separated from the support collar 150. The guide/locking pin 303 extends upward from the support collar 150, and includes a keying structure (not shown) that aligns the guide/locking pin 303 with the support collar 150. The guide/locking pin 303 also includes a passage 602 dimensioned to receive the bolt 314. The locking/alignment socket 603 is aligned to engage the guide/locking pin 303 as the gooseneck conduit assembly 302 is lowered onto the support collar 150. Each of the guide/locking pins 303 is removably coupled to the support collar 150 by bolts 604, or other attachment devices that allow the guide/locking pins 303 to be removed from the support collar 150 and/or replaced.

The diameter of the guide/locking pin 303 may vary over the length of the pin 303 to facilitate proper positioning of the gooseneck conduit assembly 302 on the support collar 150. Some embodiments of the pin 303 decrease in diameter as distance from the support collar 150 increases. For example, the embodiment of pin 303 shown in FIG. 6 features a smallest diameter at the tip of the pin 303, an intermediate diameter in a middle section of the pin 303, and a largest diameter at the base of the pin 303. The diameter of the opening 502 in the plate 320 and the passage through the locking/alignment socket 603 correspond to the diameter of the section of the pin 303 contained by the passage or opening when the gooseneck conduit assembly 302 is properly positioned on the support collar 150. The locking/alignment sockets 603 are removably coupled to the plate 320 by bolts or other attachment means that allow the locking/alignment sockets 603 to be removed from the plate 320 and/or replaced.

Returning now to FIG. 3, the secondary locking system 306 of the gooseneck conduit assembly 302 includes a hydraulic cylinder 316 that extends and/or retracts shaft 318. Shaft 318 is coupled to a locking member 326 that moves in an arc about the inner circumference of the gooseneck conduit assembly 302 and extends into a circumferential groove 1008 (FIG. 10) of the telescoping joint 130 when the shaft 318 is retracted, thereby locking the gooseneck conduit assembly 302 to the telescoping joint 130. When the shaft 318 is extended, the locking member 326 is positioned outside the circumferential groove 1008 in longitudinal channels of the telescoping joint 130, as shown in FIG. 3, to allow the gooseneck conduit assembly 302 to move longitudinally along the telescoping joint 130.

Figure 4:
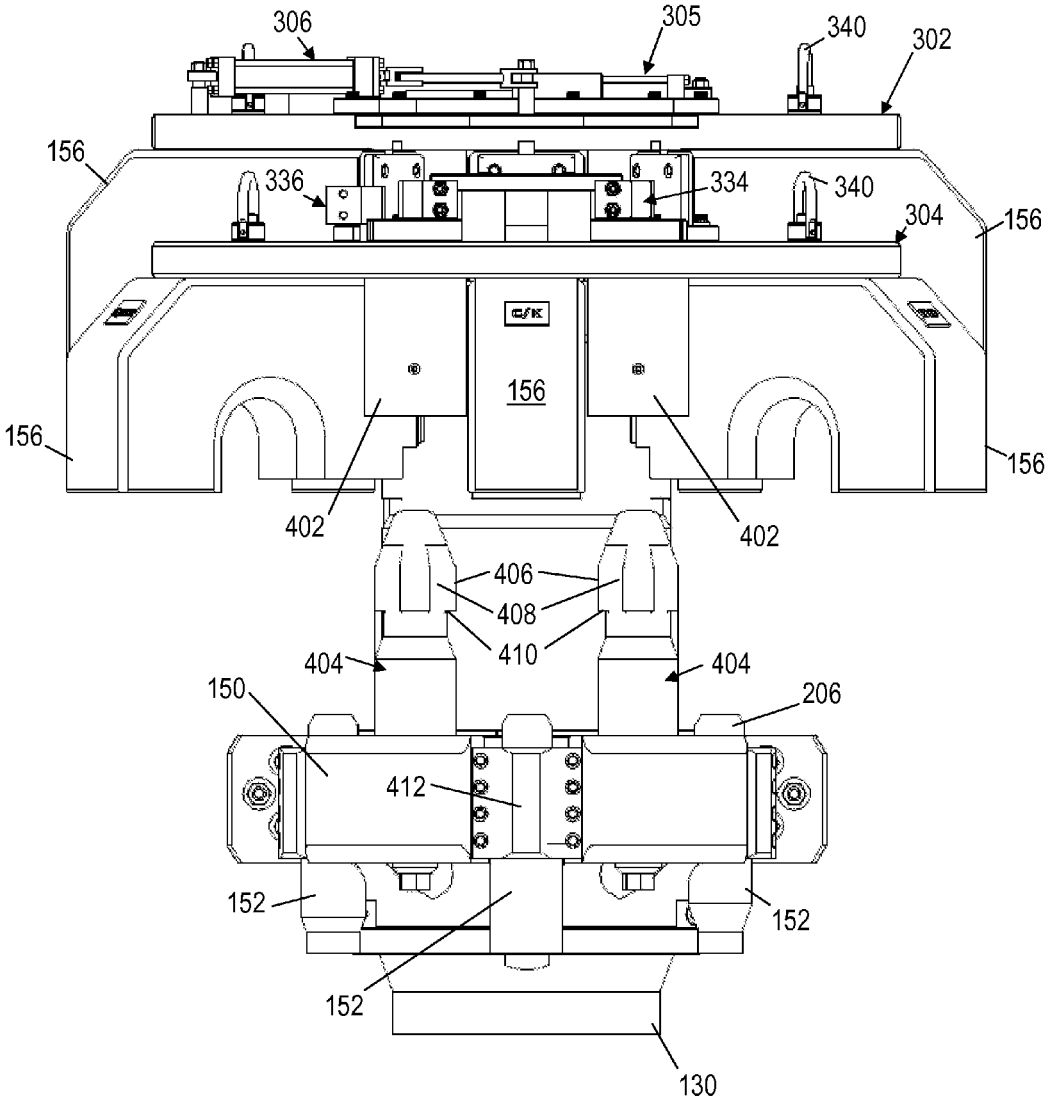
FIG. 4 shows an elevation view of a support collar and gooseneck conduit assemblies in accordance with various embodiments.

Turning now to the gooseneck conduit assembly 304, the gooseneck conduit assembly 304 includes a primary locking system 334 and a secondary locking system 336. Some embodiments of the gooseneck conduit assembly 304 may include only one of the primary locking system 334 and the secondary locking system 336. The primary locking system 334 includes rotatable guide/alignment sockets 402. FIG. 4 shows an elevation view of the gooseneck conduit assembly 304, and the rotatable guide/alignment sockets 402. The rotatable locking/alignment sockets 402 are removably coupled to the plate 320 by bolts 322 or other attachment means that allow the locking/alignment sockets 402 to be removed from the plate 320 and/or replaced.

The guide/locking pins 404 are aligned to the support collar 150 via keying structures of the pins 404 and the collar 150. The guide/locking pins 404 include alternating longitudinal ridges 406 and channels 408. The inner surface of the locking/alignment sockets 402 include alternating longitudinal channels 606 and ridges 610 (FIG. 6) corresponding to the longitudinal ridges 406 and channels 408 of the guide/locking pins 404. When the locking/alignment sockets 402 are rotated into the unlocked position (as indicated by the lock state indicator 344 of FIG. 2), the channels 606 of the locking/alignment sockets 402 align with the ridges 406 of the guide/locking pins 404 allowing the locking/alignment sockets 402 to slide onto and/or off of the guide/locking pins 404. When the gooseneck conduit assembly 304 is properly positioned (i.e., fully lowered) on the support collar 150, the rotatable locking/alignment sockets 402 may be rotated such that the longitudinal channels 606 of the locking/alignment sockets align with longitudinal channels 408 of the guide/locking pins 404, and locking surfaces 608 of the sockets 402 engage locking surfaces 410 of the guide/locking pins 404, thereby securing the gooseneck conduit assembly 304 to the support collar 150, and the gooseneck conduits 156 to the auxiliary fluid lines 152.

Different embodiments of the locking mechanism 344 may employ different degrees of rotation to transition between the locked and unlocked states. For example, the locking system 344 of FIG. 3 transitions between the locked and unlocked states with 45° of socket 402 rotation. Other embodiments may require more or less rotation to transition between states. Embodiments may also employ rotation in different directions to transition between locked and unlocked states. For example, one socket 402 of the locking system 344 transitions from the unlocked state to the locked state with clockwise rotation of the socket, while the other socket 402 of the locking system 344 requires counterclockwise rotation to transition from the unlocked state to the locked state. In other embodiments of the locking system 344, the sockets 402 may employ rotation in the same direction of transition from the unlocked state to the locked state and/or from the unlocked state to the locked state.

Referring to FIG. 6, each of the guide/locking pins 404 is removably coupled to the support collar 150 by bolts 604, or other attachment devices that allow that guide/locking pins 404 to be removed from the support collar 150 and/or replaced. The diameter of the guide/locking pin 404 may vary over the length of the pin 404 to facilitate proper positioning of the gooseneck conduit assembly 304 on the support collar 150. Some embodiments of the guide/locking pin 404 may decrease in diameter as distance from the support collar increases. For example, the embodiment of guide/locking pin 404 shown in FIG. 6 features a smallest diameter at the tip of the pin 404, an intermediate diameter in a middle section of the pin 404, and a greatest diameter at the base of the pin 404. The diameter of the passage 614 of the locking/alignment socket 402 corresponds to the diameter of the pin 404 adjacent to each circumferential section of the passage 612 when the gooseneck conduit assembly 304 is properly positioned on the support collar 150.

Returning to FIG. 3, the secondary locking system 336 includes a locking member 338 that moves in an arc around the inner circumference of the conduit assembly 304, and is secured by retaining plate and bolts 616 (FIG. 6). The locking member 338 extends into a circumferential groove 1008 (i.e., a locking groove) of the telescoping joint 130 when the secondary locking system 336 is actuated for locking, thereby locking the gooseneck conduit assembly 304 to the telescoping joint 150. In some embodiments of the secondary locking system 336, the locking member 338 is gear driven. The primary locking system 334 and the secondary locking system 336 may be hydraulically and/or directly of indirectly mechanically actuated in various embodiments. In some embodiments, the locking systems 334, 336 are hydraulically and/or mechanically coupled allowing application of hydraulic and/or mechanical force to simultaneously actuate both locking systems 334, 336. In other embodiments, the primary and secondary locking systems 334, 336 are individually actuated as shown in FIG. 3. In the embodiments of locking systems 334, 336 of FIG. 3, the locking systems are operated by direct mechanical actuation.

Figure 5:
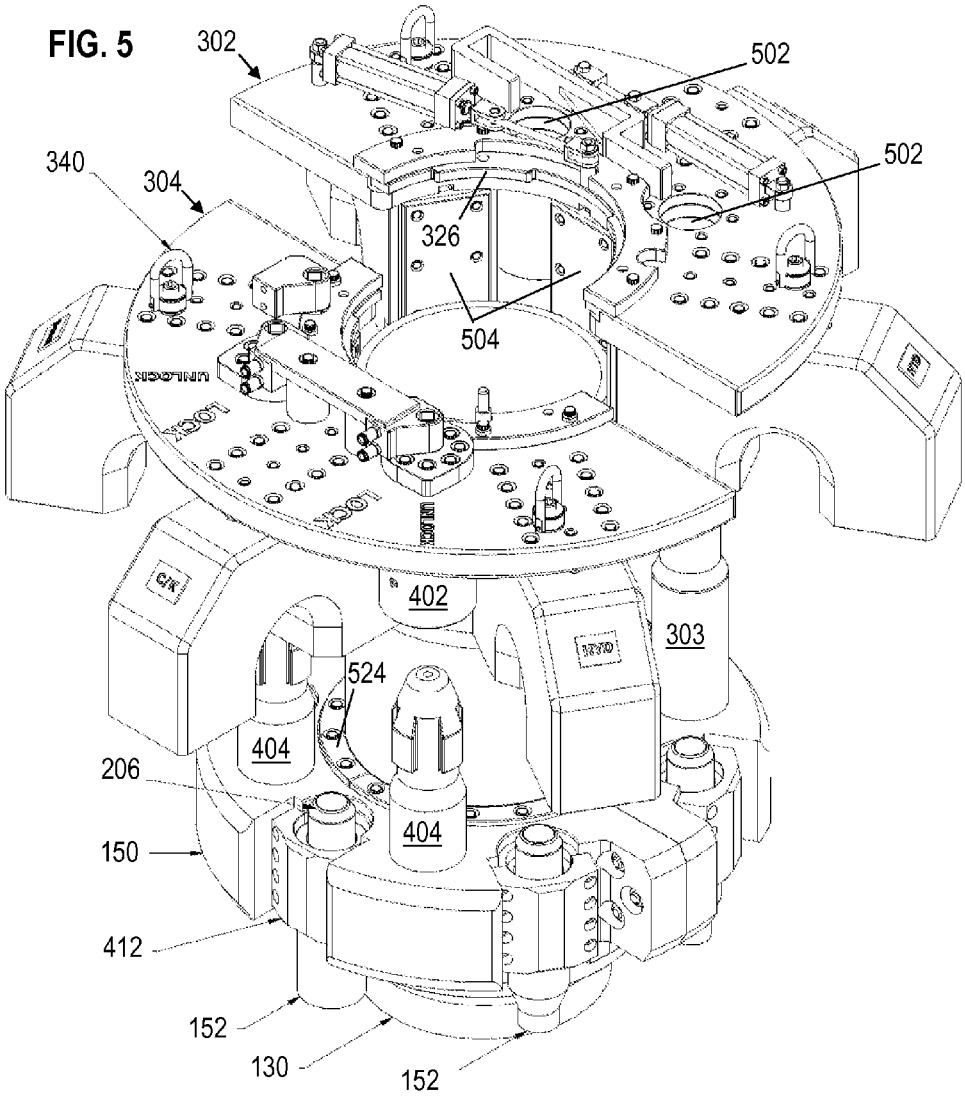
FIG. 5 shows a perspective view of the support collar and gooseneck conduit assemblies in accordance with various embodiments.

FIG. 5 shows a perspective view of the support collar 150 and the gooseneck conduit assemblies 302, 304. A bumper 504 is attached to each gooseneck conduit 156 by bolts or other retention device. The bumper 504 engages the outside of the telescoping joint 130 to aid in aligning the gooseneck conduit assembly 302, 304 and preventing conduit 156 wear during conduit assembly 302, 304 installation. In some embodiments, the bumper 504 may comprise bronze, ultra-high-molecular-weight polyethylene, or other suitable material.

An upper split retainer 524 and a lower split retainer 622 (FIG. 6) are attached to the support collar 150 to reduce support collar 150 radial loading. As shown in FIGS. 5-6, the upper split retainer 524 is bolted to the upper side of the support collar 150, and the lower split retainer is bolted to the lower side of the support collar 150. Each split retainer 524, 622 comprises two sections. The two sections of each retainer 524, 622 abut at a position 90° from the location where the support collar sections are joined. The upper split retainer 524 includes a tapered surface 626 on the inside diameter that retains and positions the support collar 150 on the telescoping joint 130. The support collar 150 also includes a key structure (not shown) for aligning the support collar 150 with a keying structure of the telescoping joint and preventing rotation of the support collar 150 about the telescoping joint 130.

Each auxiliary fluid line 152 is retained at the support collar 150 by a clamp 412 that is coupled to the support collar 150 via bolts or other retention means known in the art. The secondary locking member 326 of the secondary locking system 306 is also clearly shown in FIG. 5.

Figure 7:
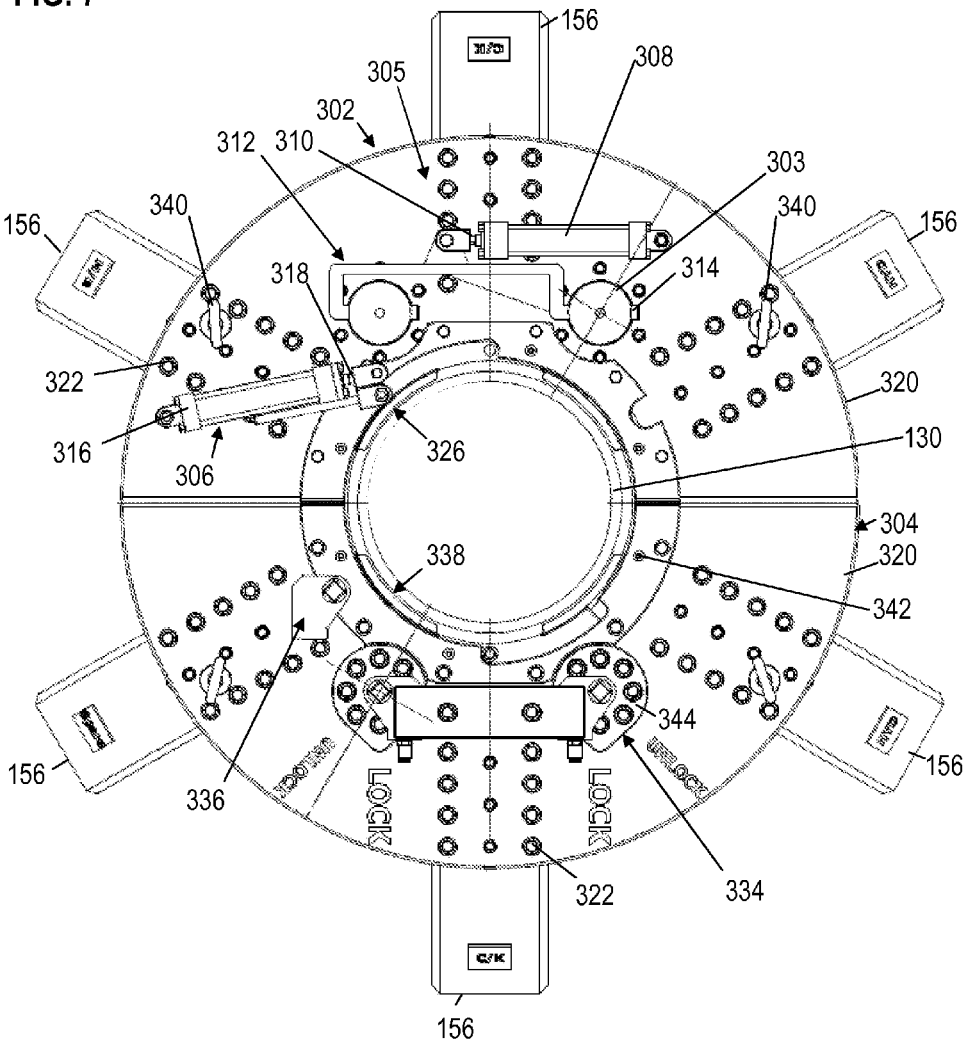
FIG. 7 shows a top of the gooseneck conduit assemblies in a locked state in accordance with various embodiments.

FIG. 7 shows a top view of the gooseneck conduit assemblies 302, 304 locked to the support collar 150. With regard to the locking mechanisms 305, 306 of the gooseneck conduit assembly 302, the shafts 310, 318 are retracted into the hydraulic cylinders 308, 316. Retraction of the shafts 310, 318 disposes the bolts 314 in the passages 602 of the guide/locking pins 303. The locking member 326 is disposed within the locking groove 1008 of the telescoping joint 130.

Turning now to the locking mechanisms 334, 336 of the gooseneck conduit assembly 304, the lock state indicators 344 are rotated to the locked position, indicating that the locking/alignment sockets 402 are locked to the guide/locking pins 404. The locking member 338 of the secondary locking mechanism 336 is disposed within the locking groove 1008 of the telescoping joint 130.

Figure 8:
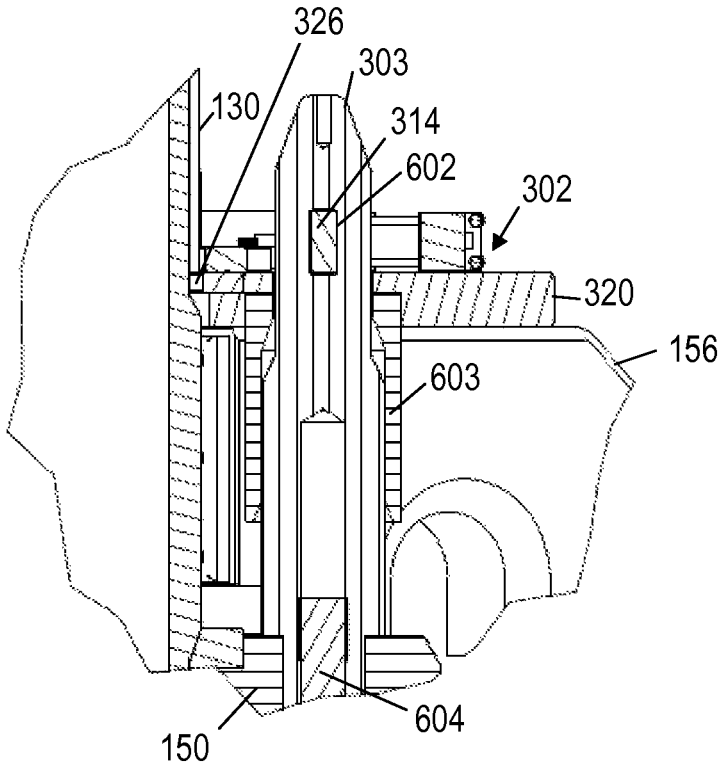
FIG. 8 shows a cross sectional view of a locking mechanism for securing a gooseneck conduit assembly to a telescoping joint in accordance with various embodiments.

FIG. 8 shows a cross-sectional view of the locking/alignment socket 603 locked to the guide/locking pin 303. The bolt 314 is disposed in the passage 602 of the pin 303, thereby locking the gooseneck conduit assembly 302 to the support collar 150. The locked state of the secondary locking mechanism 306 is also seen in FIG. 8. The locking member 326 is disposed in the locking groove 1008 of the telescoping joint 130.

Figure 9:
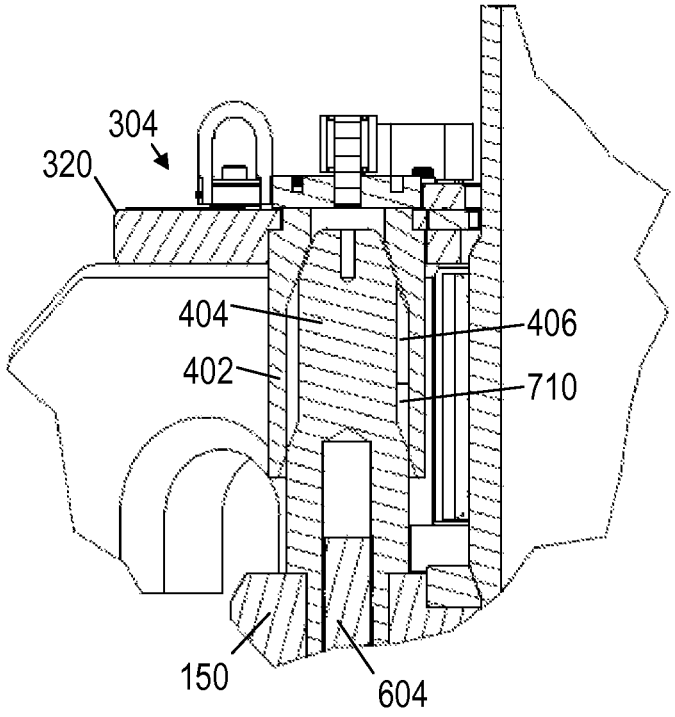
FIG. 9 shows a cross sectional view of another locking mechanism for securing a gooseneck conduit assembly to a telescoping joint in accordance with various embodiments.

FIG. 9 shows cross-sectional view of the locking/alignment socket 402 locked to the guide/locking pin 404. The locking/alignment socket 402 is rotated to align the ridge 710 of the socket 402 with the ridge 406 of the pin 404, thereby locking the gooseneck conduit assembly 304 to the support collar 150.

Figure 10:
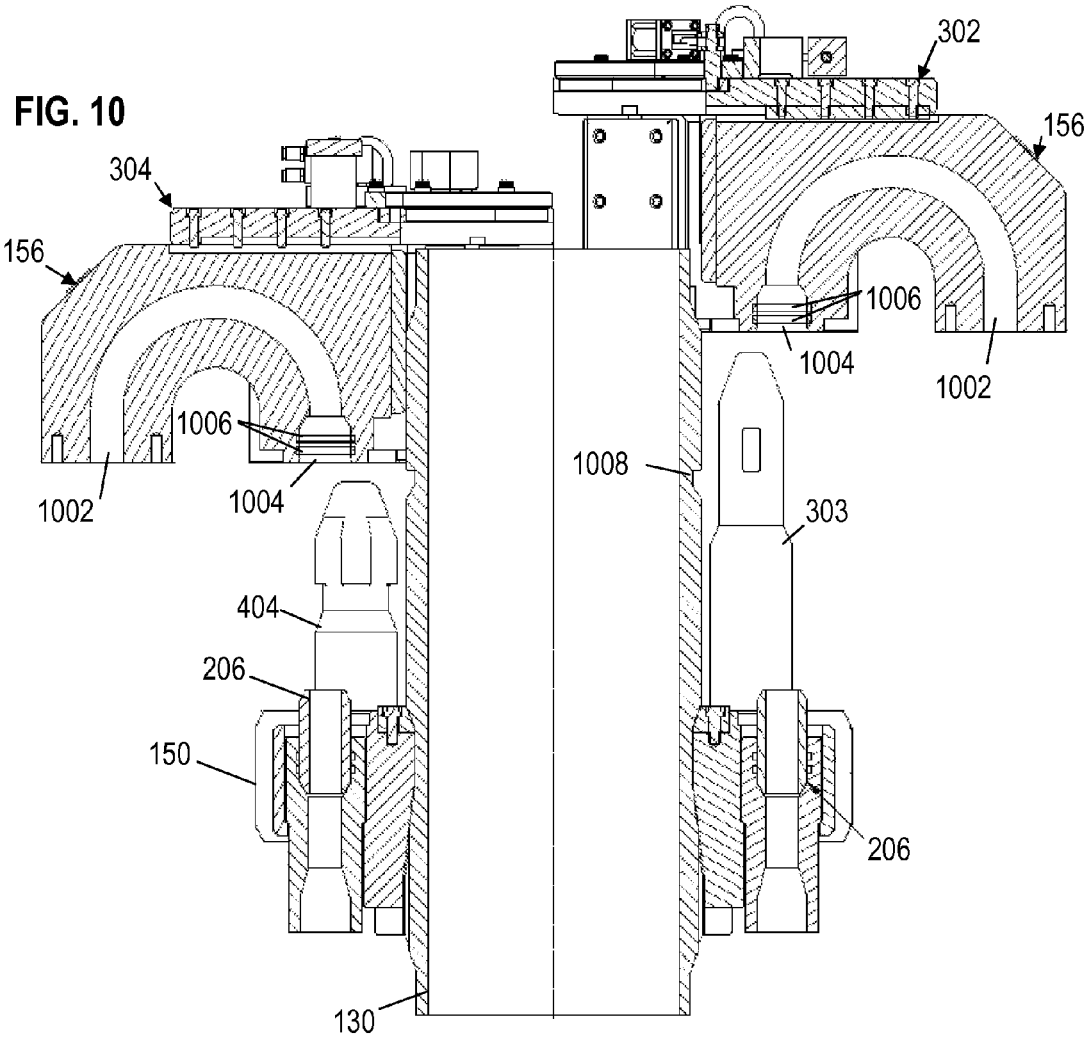
FIG. 10 shows a cross sectional view of the support collar and gooseneck conduits in accordance with various embodiments.

FIG. 10 shows a cross sectional view of the support collar 150 and gooseneck assemblies 302, 304 in accordance with various embodiments. In FIG. 9 the cross section is taken through the gooseneck conduits 156. Each gooseneck conduit 156 includes an arcing passage 1002 extending through the gooseneck conduit 156 for passing fluid between the auxiliary fluid line 152 and the hose 158. The gooseneck conduit assembly 156 may be formed by a casting process, and the thickness of material between the passage 1002 and the exterior surface of the gooseneck conduit 156 may exceed the diameter of the passage 1002 (by 2-3 or more times in some embodiments) thereby enhancing the strength and service life of the gooseneck conduit 156. The gooseneck conduit 156 includes a socket 1004 that sealingly mates with the seal sub 206 to couple the gooseneck conduit 156 to the auxiliary fluid line 152. The socket 1004 includes grooves 1006 for holding a sealing device, such as an O-ring, that seals the connection between the gooseneck conduit 156 and the sealing sub 206.

The above discussion is meant to be illustrative of the principles and various embodiments of the present invention. Numerous variations and modifications will become apparent to those skilled in the art once the above disclosure is fully appreciated. For example, the gooseneck conduit assembly 154 may be the gooseneck conduit assembly 302 or the gooseneck conduit assembly 304. Furthermore, various components of the gooseneck conduit assemblies may be interchanged. For example, primary locking system 334 may be included in a gooseneck conduit assembly with the secondary locking system 306. It is intended that the following claims be interpreted to embrace all such variations and modifications.

What is claimed is:

1. A riser telescoping joint, comprising:

a tube;

auxiliary fluid lines extending along the tube; and a gooseneck conduit assembly affixable to the tube, the gooseneck conduit assembly when affixed comprising:

a plurality of gooseneck conduits extending radially from the tube and connected with the auxiliary fluid lines; and a locking mechanism that engages a locking pin affixed to the tube, displaced from the auxiliary fluid lines, to secure the gooseneck conduit assembly to the tube.

2. The riser telescoping joint of claim 1, further comprising a support collar coupled to and extending radially from the tube, the locking pin extending from the support collar longitudinally along the tube.

3. The riser telescoping joint of claim 2, wherein the support collar comprises a plurality of clamps each retaining an end of one of the auxiliary fluid lines.

4. The riser telescoping joint of claim 3, wherein the locking pin increases in diameter in accordance with proximity to the support collar to guide the gooseneck conduits into alignment with the auxiliary fluid lines.

5. The riser telescoping joint of claim 1, wherein the locking mechanism comprises a retractable bolt extendable through a passage in the locking pin to secure the gooseneck conduit assembly to the tube.

6. The riser telescoping joint of claim 1, wherein the locking mechanism comprises a rotatable socket that receives the locking pin;

wherein the rotatable socket and the locking pin comprise complementary longitudinal ridges and channels, and the locking mechanism secures the gooseneck conduit assembly to the tube by rotating the socket to align the ridges of the socket with the ridges of the pin.

7. The riser telescoping joint of claim 6, wherein the locking mechanism comprises a pair of rotatable sockets each receiving a locking pin; wherein each socket of the pair rotates in a different direction to secure the gooseneck conduit assembly to the tube.

8. The riser telescoping joint of claim 1, wherein the locking mechanism comprises a locking member that traverses an arc about the tube; wherein the locking member comprises a projection extending towards the tube, the projection positioned in a circumferential channel of the tube to secure the gooseneck conduit assembly to the tube.

9. The riser telescoping joint of claim 1, wherein each gooseneck conduit comprises a fluid flow channel and the diameter of the fluid flow channel is less than the thickness of material of the gooseneck conduit surrounding the flow channel.

10. A gooseneck conduit unit for a telescoping joint, comprising:

a base structure;

a plurality of gooseneck conduits removably mounted to the base structure;

an alignment socket removably mounted to the base structure, wherein the alignment socket guides the gooseneck conduit unit into position about the telescoping joint; and a locking mechanism mounted to the base structure, wherein the locking mechanism secures the gooseneck conduit unit to the telescoping joint.

11. The gooseneck conduit unit of claim 10, wherein the locking mechanism comprises a hydraulic cylinder that actuates the locking mechanism.

12. The gooseneck conduit unit of claim 10, wherein the interior diameter of the alignment socket increases with distance from the base structure.

13. The gooseneck conduit unit of claim 10, wherein the locking mechanism comprises a retractable bolt that extends through a passage in a locking pin coupled to the telescoping joint to secure the gooseneck conduit unit to the telescoping joint.

14. The gooseneck conduit unit of claim 10, wherein the alignment socket is rotatably coupled to the locking mechanism, and the alignment socket comprises alternating ridges and channels corresponding to ridges and channels of a locking pin coupled to the telescoping joint; wherein the locking mechanism rotates the alignment socket to align the ridges of the socket and the pin to secure the gooseneck conduit unit to the telescoping joint.

15. The gooseneck conduit unit of claim 14, further comprising a pair of alignment sockets; wherein the locking mechanism rotates each socket of the pair in a different direction to secure the gooseneck conduit unit to the telescoping joint.

16. The gooseneck conduit unit of claim 10, wherein the locking mechanism comprises a locking member that traverses an arc about an inner circumference of the gooseneck conduit unit; wherein the locking member comprises a projection extending from the inner circumference, the projection dimensioned to engage walls of a circumferential channel of the telescoping joint to secure the gooseneck conduit assembly to the telescoping joint.

17. The gooseneck conduit unit of claim 10, wherein each gooseneck conduit comprises a fluid flow channel and the diameter of the fluid flow channel is less than the thickness of material of the gooseneck conduit surrounding the flow channel.

18. A system, comprising:

a surface platform;

a riser;

a blow-out preventer coupled to the riser;

a telescoping joint coupling the riser to the surface platform; the telescoping joint comprising:

a support collar for securing at least one gooseneck conduit assembly to the telescoping joint, the gooseneck conduit assembly including gooseneck conduits and the support collar comprising a plurality of locking pins each dimensioned to align the gooseneck conduit assembly with auxiliary fluid lines disposed about the telescoping joint, and to secure the gooseneck conduit assembly to the telescoping joint.

19. The system of claim 18, further comprising at least one gooseneck conduit assembly, wherein each gooseneck conduit assembly comprises:

an alignment socket that engages one of the locking pins to align the gooseneck conduit assembly with the auxiliary fluid lines; and a locking mechanism that secures the gooseneck conduit assembly to the locking pins.

20. The system of claim 19, wherein the locking mechanism comprises at least one of:

a retractable bolt dimensioned to extend through a passage in one of the locking pins to secure the gooseneck conduit assembly to the locking pin;

alternating ridges and channels on an interior surface of the alignment socket; wherein the locking mechanism rotates the alignment socket to align the ridges of the alignment socket with ridges of one of the locking pins to secure the gooseneck conduit assembly to the locking pin; and a locking member that traverses an arc about the telescoping joint; wherein the locking member comprises a projection extending towards the telescoping joint, the projection positioned in a circumferential channel of the telescoping joint to secure the gooseneck conduit assembly to the telescoping joint.

21. The system of claim 18, further comprising at least one of:

a plurality of clamps attached to the support collar, each clamp securing to the support collar an end of one of the auxiliary fluid lines disposed about the telescoping joint;

an upper split ring retainer coupled to the top of the support collar and disposed orthogonal to sections of the support collar; and a lower split ring retainer coupled to the top of the support collar and disposed orthogonal to sections of the support collar.

* * * * *